United States Patent [19]

Severson et al.

[11] Patent Number: 4,982,885

[45] Date of Patent: Jan. 8, 1991

[54] INTERACTIVE COUPLING DEVICES

[75] Inventors: Sandra S. Severson; Larry E. Severson, both of 724 Second St. N.W., Waseca, Minn. 56093

[73] Assignees: Larry Severson; Sandie Severson, both of Waseca, Minn.

[21] Appl. No.: 322,566

[22] Filed: Mar. 13, 1989

[51] Int. Cl.[5] ..... A45F 5/00; A45C 11/00

[52] U.S. Cl. ..... 224/253; 224/904; 224/250; 224/255; 294/157; 294/138; 24/324; 24/622

[58] Field of Search ..... 224/901, 905, 917, 150, 224/202, 205, 226, 250, 253, 254, 255, 257, 258, 264, 913; 294/138, 147, 149, 155, 154, 157; 24/622, 324, 306, 442

[56] References Cited

U.S. PATENT DOCUMENTS

| | | | |
|---|---|---|---|
| 272,067 | 2/1883 | Lindsay | 294/149 X |
| 738,462 | 9/1903 | Lincoln | 294/138 X |
| 2,530,695 | 11/1950 | Helmert | 294/157 X |
| 3,087,277 | 4/1963 | McCook | 224/205 X |
| 3,377,007 | 4/1968 | Gayler, Jr. | 224/205 |
| 3,813,017 | 5/1974 | Pimsleur | 224/901 X |
| 3,960,302 | 6/1976 | Mazzoni, Jr. | 294/147 |
| 4,114,838 | 9/1978 | Knaut | 294/157 |
| 4,337,938 | 7/1982 | Rodriguez | 224/258 |
| 4,496,088 | 1/1985 | Tuthill | 224/253 |
| 4,815,172 | 3/1989 | Ward | 24/16 R |

FOREIGN PATENT DOCUMENTS

| | | | |
|---|---|---|---|
| 3128920 | 2/1983 | Fed. Rep. of Germany | 224/257 |
| 2493117 | 5/1982 | France | 294/157 |

*Primary Examiner*—Ernest G. Cusick

*Attorney, Agent, or Firm*—Merchant, Gould, Smith, Edell, Welter & Schmidt

[57] ABSTRACT

A device for coupling two or more items such as luggage, which includes a longitudinal length of material with first and second groups of snaps at each end thereof for looping the longitudinal ends of the longitudinal length of material and a third group of snaps intermediate the ends for the purpose of forming an interior loop of the longitudinal length of material and thereby increasing/decreasing the length of the longitudinal length of material.

10 Claims, 2 Drawing Sheets

INTERACTIVE COUPLING DEVICES

FIELD OF THE INVENTION

Our invention relates to apparatuses and systems useful for unifying separate and independent components and/or securing unruly items in an orderly fashion.

BACKGROUND OF THE INVENTION

It is a well recognized principle that the handling, transportation and storage of multiple components can be significantly simplified by physically combining the individual components into a composite unit. Implementation of this general principle is embodied in such common everyday products as cardboard boxes, plastic trash bags, paper grocery sacks, egg cartons, brief cases, luggage, shopping carts, etc.

Similar to this first principle is the related principle that the handling, transportation, storage and use of unruly items such as electrical cords, battery cables, garden hoses, landscaping trim, etc. can be significantly simplified by securing the item in an orderly fashion. Implementation of this general principle is embodied in such common everyday products as twist-ties, ratchet-ties, rubberbands, garden hose reels, electrical cord reels, etc.

Many different apparatuses and systems, based upon these simple principles, have been created and used to solve a wide variety of problems associated with the storage, shipping, handling and use of multiple and/or unruly items. However, the search continues for new and different apparatuses and systems capable of improving the storage, shipping, handling and use of various items.

SUMMARY OF THE INVENTION

Figure 1:
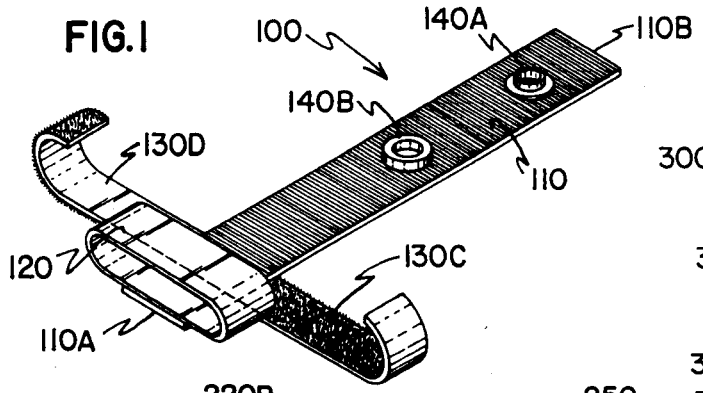
FIG. 1 is a perspective view of a first aspect of our invention.

The first aspect of our invention is a device suitable for hanging a variety of items such as a cordless telephone handset from a belt, belt loop or similar article. The device comprises a longitudinal length of material such as a strap coupled at one longitudinal end thereof to a looped elastic band for suitable encircling and retaining an item, and having a fastening means proximate the other longitudinal end thereof for unfastenably looping the longitudinal length of material.

A second aspect of our invention is a device useful for coupling multiple items so that the items may be handled and transported as a single unit. The device comprises a longitudinal length of material such as a strap having spaced fastening means proximate both longitudinal ends thereof for unfastenably looping each longitudinal end of the longitudinal length of material.

A third aspect of our invention is a device having a wide variety of uses including specifically, but not exclusively: securing the male end of an electrical cord to an electrical outlet, securing together the mated ends of two electrical cords, retaining a garden hose or electrical cord in an organized fashion, hanging objects from a hook, etc. The device comprises: (i) a longitudinal length of material such as a strap having first and second longitudinal ends; (ii) a first pair of laterally extending lengths of material extending in laterally opposite directions (one to the left and one to the right of the longitudinal length of material) proximate the first end of the longitudinal length of material; (iii) a second pair of laterally extending lengths of material extending in laterally opposite directions (one to the left and one to the right of the longitudinal length of material) proximate the second end of the longitudinal length of material; (iv) a first fastening means for unfastenably coupling the first pair of laterally extending lengths of material so as to form a first lateral loop therefrom; and (v) a second fastening means for unfastenably coupling the second pair of laterally extending lengths of material so as to form a second lateral loop therefrom.

A fourth aspect of our invention is a device useful for coupling multiple items so that the items may be handled as a single unit, which comprises: (i) a longitudinal length of material such as a strap folded back upon itself and coupled so as to form a permanent middle loop, and a pair of appendages radiating from the coupling point, and (ii) a fastening means for unfastenably coupling the appendages to each other to form a loop therefrom.

As utilized herein, the phrase "length of the longitudinal/lateral length of material" refers to the complete unfolded and unlooped length of the longitudinal/lateral length of material. In contradistinction, as utilized herein, the phrase "length of the device" or "length of the attachment" refers to the length of the device or attachment as a whole after the device or attachment has been folded or looped at the longitudinal ends thereof as would be done during use of the device or attachment.

DETAILED DESCRIPTION OF THE INVENTION INCLUDING THE PREFERRED EMBODIMENT

A first aspect of our invention, generally depicted in FIG. 1, is a device 100 for hanging objects (not shown) from a belt, belt loop or similar article (not shown). The device 100, includes: (i) a longitudinal length of material 110 having a first end **110*a* and a second end 110*b*, (ii) a laterally extending loop of elastic material 120 proximate the first end 110*a* of longitudinal length of material 110 for securably retaining the object to be hung, and (iii) a fastening means 140*a*, 140*b* proximate the second end 110*b* of longitudinal length of material 110 for unfastenably longitudinally looping the second end 110*b* of the longitudinal length of material 110**.

Device 100 may further include laterally extending lengths of material **130*c*, 130*d* coupled to the longitudinal length of material 110 proximate the first longitudinal end 110*a* thereof. Laterally extending lengths of material 130*a*, 130*d* include a first laterally extending length of material 130*c* which extends in a first lateral direction and a second laterally extending length of material 130*d* which extends in a second lateral direction which is laterally opposed to the first lateral direction. Preferably the laterally extending lengths of material 130*c*, 130*d* extend as mirror images and perpendicular to the longitudinal length of material 110**.

The laterally extending lengths of material 130c, 130d need not necessarily be diametrically opposed nor mirror images. Rather, the descriptive term "laterally opposed" or "laterally opposite", when referring to the laterally extending lengths of material 130c, 13d is intended to mean simply that the first 130c and second 130d laterally extending lengths of material 130c, 130d extend from the longitudinal length of material 110 toward different east/west: right/left directions.

Device 100 includes a means for unfastenably coupling the laterally extending lengths of material 130c, 130d so that variable-diameter loops may be formed therefrom. Examples of such unfastenable coupling means include specifically, but not exclusively: hooked surface/looped surface tape, releasable ratchet systems, clasps, etc. The preferred coupling means for unfastenably coupling the laterally extending lengths of material 130c, 130d is hooked surface/looped surface tape.

It is within the scope of this invention for laterally extending lengths of material 130c, 130d to be constructed solely of hooked surface/looped surface tape, such as shown in FIG. 1, such that the coupling means is an integral part of the laterally extending length of material 130c, 130d.

When laterally extending lengths of material 130c, 130d are coupled by means of hooked surface/looped surface tape, it is preferred that the interactive hooked surface and looped surface faces of the laterally extending lengths of material 130c, 130d are presented for use on opposite sides of the laterally extending lengths of material 130c, 130d when the laterally extending lengths of material 130c, 130d are in a flat position. Such an orientation allows laterally extending lengths of material 130c, 130d to form a flat, overlapping, cylindrical loop rather than a face-to-face, teardrop-shaped loop when coupled.

Elastic loop 120 preferably has an unexpanded circumference of about 4 inches to about 10 inches and extends laterally from the longitudinal length of material 110.

Longitudinal length of material 110 can be fabricated to any desired length, width and thickness. For most currently envisioned uses, device 100 should have a length of about 4 inches to about 2 feet and longitudinal length of material 110 should have a length of about 6 inches to about 3 feet, a width of about 0.2 inches to about 2 inches, and a thickness sufficient to obtain the desired strength and flexibility properties. Preferably, when used to hang a cordless telephone handset (not shown) from a belt or belt loop (not shown), device 100 should have a length of about 4 inches to about 1 foot and the longitudinal length of material 110 a length of about 6 inches to about 1 foot.

Similar to the longitudinal length of material 110, laterally extending lengths of material 130c, 130d can be fabricated to any desired length, width and thickness. For most currently envisioned uses, each laterally extending length of material 130c, 130d should independently have a length of about 2 inches to about 1 foot, a width of about 0.2 to about 2 inches, and a thickness sufficient to obtain the desired strength and flexibility properties. When intended to be used to secure a telephone handset (not shown) laterally extending lengths of material 130c, 130d preferably have substantially identical lengths of about 2 inches to about 6 inches and are capable of forming a loop having a circumference of about 4 inches to about 8 inches.

Longitudinal length of material 110 and laterally extending lengths of material 130c, 130d can be manufactured from a number of suitably strong and flexible materials, including specifically, but not exclusively: natural fabrics such as cotton and wool and synthetic fabrics such as nylon and polyester, in either woven or unwoven form.

Device 100 includes a fastening means 140l, 140b proximate the second longitudinal end 110b of the longitudinal length of material 110 for forming a longitudinal loop at the second longitudinal end 110b of the longitudinal length of material 110. Such looping of longitudinal length of material 110 permits the longitudinal length of material 110 to be coupled to a belt or belt loop (not shown). Examples of suitable fastening means include specifically, but exclusively: hooked surface/looped surface tape, releasable rachet systems, clasps, snap combinations, button/button hole combinations, etc. The preferred fastening means for looping the longitudinal length of material 110 is a snap combination 140a, 140b consisting of a male half 140a and a female half 140b.

The male 140a and female 140b halves are preferably sufficiently spaced so that a loop having a circumference of about 2 inches to about 1 foot may be formed from the longitudinal length of material 110.

Figure 2:
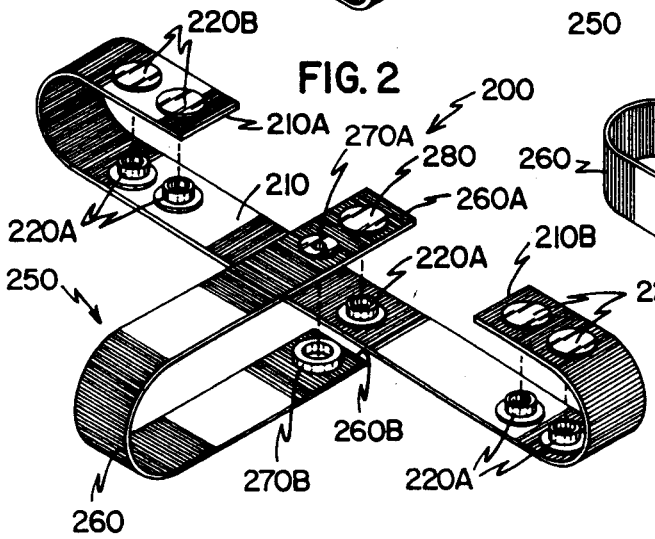
FIG. 2 is a perspective view of a first embodiment of a second aspect of our invention.
Figure 3:
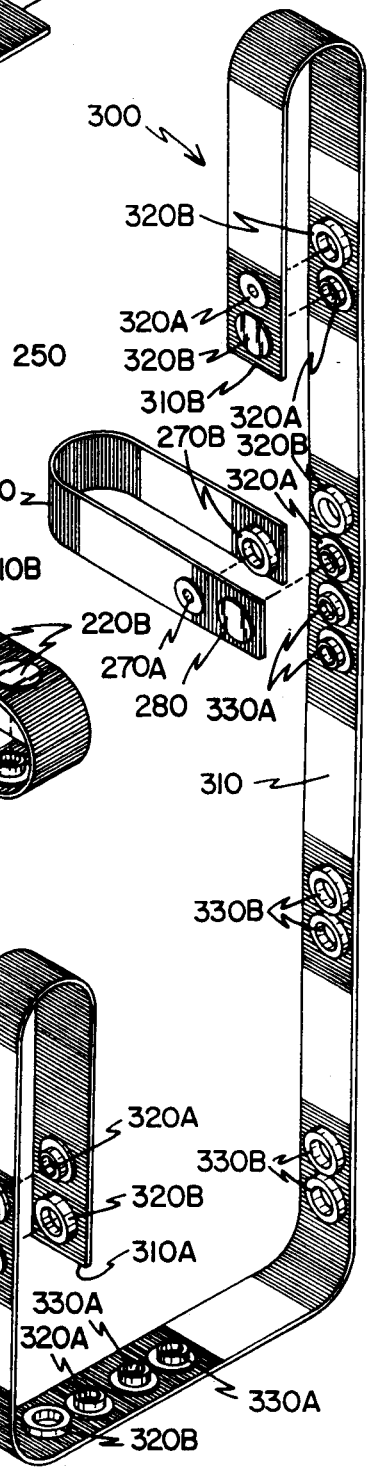
FIG. 3 is a perspective view of a second embodiment of the second aspect of our invention.

A second aspect of our invention, generally depicted in FIGS. 2 and 3, is a device 200, 300 useful for coupling two or more items (not depicted) into a single unit and thereby simplifying the handling and transportation of such items. The device 200, 300 includes: (i) a longitudinal length of material 210, 310 having a first longitudinal end 210a, 310a and a second longitudinal end 210b, 310b, and (ii) fastening means 220a, 220b 320a, 320b proximate both the first longitudinal end 210a, 310a and second longitudinal end 210b, 310b of the longitudinal length of material 210, 310 for forming a longitudinal loop at both ends of the longitudinal length of material 210, 310. Such looping of longitudinal length of material 210, 310 permits the longitudinal length of material 210, 310 to be looped around and retain multiple items (not shown).

Examples of suitable fastening means include specifically, but not exclusively: hooked surface/looped surface tape, releasable rachet systems, clasps, snap combinations, button/button hole combinations, etc., The preferred fastening means is a snap combination 220a, 220b 320a, 320b consisting of a male portion 220a, 320a and a female portion 220b, 320b.

The male 220a, 320a and female 220b, 320b portions of the fastening means 220a, 220b are preferably sufficiently spaced so that longitudinal end loops having a circumference of at least about 2 inches and most preferably about 2 inches to about 1 foot may be formed.

Longitudinal length of material 210, 310 can be fabricated to any desired length, width and thickness. For most currently envisioned uses, device 200, 300 should have a length of about 6 inches to about 6 feet and longitudinal length, of material 210, 310 should have a length of about 1 foot to about 10 feet, a width of about 0.2 inches to about 2 inches and a thickness sufficient to obtain the desired strength and flexibility properties. When device 200, 300 is intended for use in hand carrying items (FIG. 2) the device 200 should have a longitudinal length of about 6 inches to about 2 feet. When device 200, 300 is intended to be used in carrying items across the shoulder (FIG. 3) the device 300 should have a longitudinal length of about 3 feet to about 6 feet.

Device 300 may include additional fastening means 330*a*, 330*b* for either (i) shortening the distance between the longitudinal ends 310*a*, 310*b* of the longitudinal length of material 310 by looping the middle of the longitudinal length of material 310, and/or (ii) increasing the size of the end loops by employing fastening means 330*a*, 330*b* which are compatible with fastening means 320*a*, 320 *b*. The interior or middle loop formed by fastening means 330*a*, 330*b* may be employed to retain additional item(s) and preferably has a circumference of about 4 inches to about 2 feet.

Longitudinal length of material 210, 310 can be manufactured from a number of suitably strong and flexible materials including specifically, but not exclusively: natural fabrics such as cotton and wool and synthetic fabrics such a nylon and polyester, in either woven or unwoven form.

Device 200, 300 may include an attachment 250 (FIG. 2) which comprises: (i) a longitudinal length of material 260 having a first longitudinal end 260*a* and a, second longitudinal end 260*b*, (ii) a fastening means 270*a*, 270*b* for longitudinally looping the second end 260*b* of the longitudinal length of material 260, and (iii) one-half of a fastening means 280 compatible with fastening means 220*a*, 220*b* 320*a*, 320*b* 230 and/or 330*a*, 330*b* for allowing attachment 250 to be coupled to device 200, 300.

Longitudinal length of material 260 can be fabricated to any desired length, width and thickness. For most currently envisioned uses, attachment 250 should have a length, of about 3 inches to about 3 feet and the longitudinal length of material should have a width of about 0.2 inches to about 2 inches and a thickness sufficient to obtain the desired strength and flexibility properties. Most preferably, attachment 250 has a length of about 6 inches to about 2 feet and the longitudinal length of material has a width and thickness which corresponds to the width and thickness of the longitudinal length of material employed in device 200, 300 to which it is to be coupled.

Fastening means suitable for use as fastening means on attachment 250 include those listed as suitable for use on device 200, 300 and include hooked surface/looped surface tape, releasable ratchet systems, clasps, snap combinations, button/button hole combinations, etc. It is preferred to employ a fastening means 270*a*, 270*b* on attachment 250 which is compatible with the device 200, 300 to which the attachment 250 is to be used which, in the preferred embodiment would be a snap combination comprising a male half 270*a* and a female half 270*b*.

Figure 4:
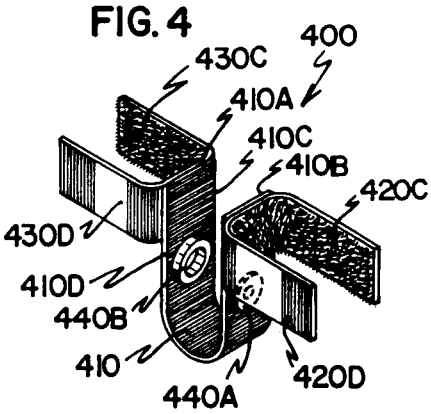
FIG. 4 is a perspective view of a third aspect of our invention.

A third aspect of our invention, generally depicted in FIG. 4, is an inexpensive yet efficient coupling device 400 having a wide variety of uses including specifically, but not exclusively: securing the male end of an electrical cord to an electrical outlet, securing together the mated ends of two electrical cords, retaining a garden hose, electrical cord or similarly unruly item in an organized fashion, hanging objects, etc.

The device 400 includes a longitudinal length of material 410 having a first longitudinal end 410*a*, a second longitudinal end 410*b*, a first side 410*c* and a second side 410*d*. Coupled to the longitudinal length of material 410 proximate the first longitudinal end 410*a* thereof is a first pair of laterally extending lengths of material 420. The first pair of laterally extending lengths of material 420 includes a first laterally extending length of material 420*c* laterally extending to the first side 410*a* of the longitudinal length of material 410 and a second laterally extending length of material 420*d* laterally extending to the second side 410*d* of the longitudinal length of material 410. Similarly, a second pair of laterally extending lengths of material 430 are coupled to the longitudinal length of material 410 proximate the second longitudinal end 410*b* thereof and includes a first laterally extending length of material 430*c* laterally extending to the first side 410*c* of the longitudinal length of material 410 and a second laterally extending length of material 430*d* laterally extending to the second side 410*d* of the longitudinal length of material 410. The paired, laterally extending lengths of material 420, 430 preferably extend as mirror images of these paired mate and perpendicular to the longitudinal length of material 410.

The paired, laterally extending lengths of material 420, 430 need not necessarily be diametrically opposed nor mirror image pairs. Rather, the descriptor "laterally opposed" or "laterally opposite", when referring to the paired, laterally extending lengths of material 420, 430, is intended to mean simply that the first 420*c*, 430*c* and mated second 420*d*, 430*d* laterally extending paired lengths of material 420, 430 extend from the longitudinal length of material 410 to different sides 410*c*, 410*d* thereof.

Device 400 includes a means for unfastenably coupling the paired, laterally extending lengths of material 420, 430 so as to form variable-diameter lateral loops from each pair. Examples of such unfastenable coupling means include specifically, but not exclusively: hooked surface/looped surface tape, releasable ratchet systems, clasps, etc. The preferred coupling means for unfastenably coupling the paired, laterally extending lengths of material 420, 430 is hooked surface/ looped surface tape.

It is within the scope of this invention for laterally extending lengths of material 420, 430 to be constructed solely of hooked surface/looped surface tape, such as shown in FIG. 4, such that the coupling means is an integral part of the laterally extending lengths of material 420, 430.

When laterally extending lengths of material 420, 430 are coupled by means of hooked surface/looped surface tape, it is preferred that the lengths having the hooked surface 420*d*, 430*c* extend in laterally opposed directions while lengths having the looped surface 420*c*, 430*d* likewise extend in laterally opposed directions. Such a configuration allows longitudinal length of material 410 to be looped by coupling lateral length of material 420*d* (hooked) to lateral length of material 430*d* (looped) and lateral length of material 420*c* (looped) to lateral length of material 430*c* (hooked). In addition, when laterally extending lengths of material 420, 430 are coupled by means of hooked surface/looped surface tape it is also preferred that the interactive hooked surfaces and looped surface faces of the laterally extending lengths of material 420, 430 are presented for use on the same side of the laterally extending lengths of material 420, 430 when device 400 is in a completely flat position. Such an orientation allows coupling of the paired laterally extending length of material to form face-to-face, teardrop-shaped or mobius band loops rather than flat, overlapping, cylindrical loops.

Longitudinal length of material 410 can be fabricated to any desired length, width and thickness. For most currently envisioned uses, longitudinal length of material 410 should have a length of about 3 inches to about 2 feet, a width of about 0.2 inches to about 2 inches, and a thickness sufficient to obtain the desired strength and flexibility properties. When device 400 is intended to be used to secure the male end of an electrical cord in an electrical outlet or to secure together the mated ends of two electrical cords, the longitudinal length of material 410 preferably has a length of about 4 inches to about 6 inches.

Similar to the longitudinal length of material 410, laterally extending, paired lengths of material 420, 430 may be fabricated to any desired length, width and thickness. For most currently envisioned uses, each laterally extending lengths of material 420, 430 should independently have a length of about 2 inches to about 1 foot, a width of about 0.2 to about 2 inches, and a thickness sufficient to obtain the desired strength and flexibility properties. When intended to be used to secure the male end of an electrical cord to an electrical outlet or to secure together the mated ends of two electrical cords, each laterally extending length of material 420, 430 preferably has substantially identical lengths of about 2 inches to about 4 inches.

Longitudinal length of material 410 and laterally extending lengths of material 420, 430 can be manufactured from a number of suitably strong and flexible materials including specifically, but not exclusively: natural fabrics such as cotton and wool and synthetic fabrics such as nylon and polyester, in either woven or unwoven form.

Device 410 may include a fastening means for shortening the longitudinal distance between the paired, laterally extending lengths of material 420 and 430 by looping the middle of the longitudinal length of material 410. One example of such a fastening means is a longitudinally spaced snap combination 440 coupled to the longitudinal length cf material 410 which consists of a male portion **440*a* and a female portion 440*b* which are longitudinally spaced along the longitudinal length of material 410**.

Figure 5:
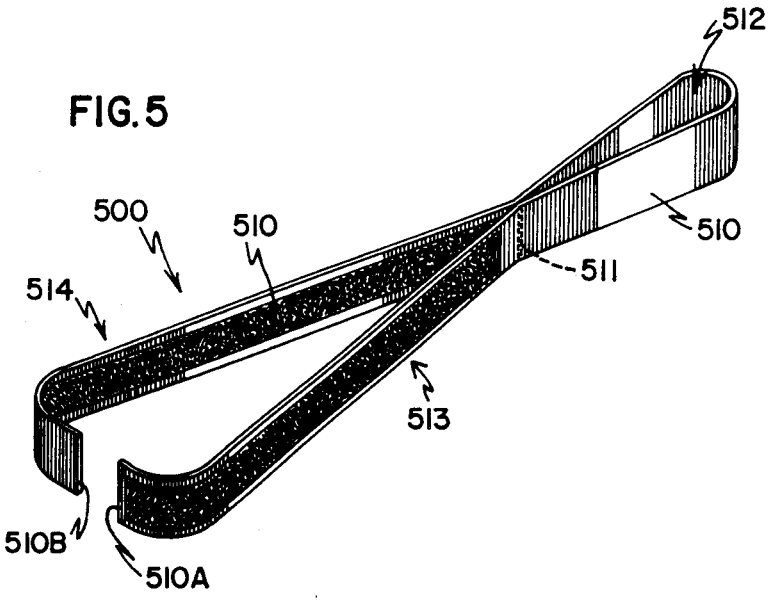
FIG. 5 is a perspective view of a fourth aspect of our invention.

A fourth aspect of our invention, generally depicted in FIG. 5, is a device 500 useful for coupling multiple items (not depicted) and thereby simplifying the handling and transportation of such items. The device 500 includes a longitudinal length of material 510 having a first longitudinal end **510*a* and a second longitudinal 510*b* which is unfastenably coupled to itself at coupling point 511 so as to form an unfastenable loop 512 and a pair of appendages 513 and 514 radiating from the coupling point 511**.

Longitudinal length of material 510 may be permanently coupled to itself at coupling point 511 by any suitable means including sewing, application of an adhesive, thermal welding, etc.

Loop 512 must be of sufficient size to allow a hand to be inserted through the loop 512 for grasping the device 500. Accordingly, loop 512 preferably has a circumference of about 6 inches to about 2 feet and most preferably about 8 inches to about 1 foot.

Appendages 513, 514 can be constructed to any desired length, width and thickness. For most currently envisioned uses, appendages 513, 514 should have independent lengths of about 4 inches to about 2 feet, a width of about 0.2 inches to about 2 inches and a thickness sufficient to obtain the desired strength and flexibility properties. Preferably, appendages 513, 514 have substantially identical lengths of about 4 inches to about 1 foot and are capable of forming an unfastenable loop having a circumference of about 6 inches to about 2 feet.

Longitudinal length of material 510 can be manufactured from a number of suitably strong and flexible materials including specifically, but not exclusively: natural fabrics such as cotton and wool and synthetic fabrics such a nylon and polyester, in either woven or unwoven form.

Device 500 includes a means for unfastenably coupling appendages 513, 514 so that variable-diameter loops may be formed from the appendages 513, 514. Examples of such unfastenable coupling means include specifically, but not exclusively: hooked surface/looped surface tape, releasable ratchet systems, clasps, etc. The preferred coupling means for unfastenably coupling the appendages 513, 514 is hooked surface/loop surface tape which continuously runs substantially the entire longitudinal length of the appendages 513, 514.

It is within the scope of this invention for appendages 513, 514 to be constructed solely of hooked surface/-looped surface tape such that the coupling means is an integral part of the appendages 513, 514.

When appendages 513, 514 are coupled by means of hooked surface/looped surface tape, it is preferred that the interactive hooked surface and looped surface faces of the appendages 513, 514 are presented for use on the same sides of the appendages 513, 514 when device 500 is in a completely flat position. Such an orientation allows coupling of the appendages 513, 514 to form a flat, overlapping, cylindrical loop rather than a face-to-face, teardrop-shaped loop.

All aspects of our invention may be employed in any combination for the purpose of coupling multiple items. In this respect, it is preferred that the various aspects employ compatible fastening means to allow the severed devices to function together.

The specification is presented to aid in the complete non-limiting understanding of our invention. Since many variations and embodiments of the invention can be made without departing from the spirit and scope of our invention, our invention resides in the claims hereafter appended.

We claim:

1. An apparatus, comprising: (i) a longitudinal length of material constructed from a single component and having first and second ends, (ii) a first unfastenable fastening means proximate the first end for forming a first longitudinal loop of the longitudinal length of material when fastened, (iii) a second unfastenable fastening means compatible with the first unfastenable fastening means and proximate the second end for forming a second longitudinal loop of the longitudinal length of material when fastened, and (iv) a third fastening means compatible with and intermediate the first and second fastening means suitable for (aa) looping the longitudinal length of material between the first and second fastening means so as to form a third longitudinal loop from the longitudinal length of material when fastened and thereby decrease the longitudinal length of the longitudinal length of material, and (bb) forming primary and secondary longitudinal loops at the first and second longitudinal ends of the longitudinal length of material when fastened to the first and second fastening means respectively.

2. The apparatus of claim 1 wherein the apparatus has a longitudinal length of about 6 inches to about 2 feet when the first and second fastening means are fastened.

3. The apparatus of claim 2 wherein the first and second loops formed by the first and second fastening means each independently having a circumference of about two inches to about one foot.

4. The apparatus of claim 4 wherein the apparatus has a longitudinal length of about 3 feet to about 6 feet when the first and second fastening means are fastened.

5. The apparatus of claim 1 wherein the longitudinal length of material is a woven synthetic fabric.

6. The apparatus of claim 1 wherein the first and second longitudinal loops formed by the first and second fastening means each independently having a circumference of at least about two inches.

7. The apparatus of claim 1 wherein the first and second fastening means are selected from the group consisting of snaps and hooked surface/looped surface tape.

8. The apparatus of claim 1 wherein the first and second fastening means include multiple fastening locations such that the circumference of the first and second loops formed by fastening the first and second fastening means to themselves may be varied.

9. The apparatus of claim 1 wherein the third loop formed by the third fastening means has a circumference of about four inches to about two feet.

10. The apparatus of claim 1 wherein the third fastening means includes multiple fastening locations such that the circumference of the third loop may be varied.

* * * * *